US008963360B1

(12) United States Patent
Loo

(10) Patent No.: US 8,963,360 B1
(45) Date of Patent: Feb. 24, 2015

(54) HYDRO-ELECTRIC SYSTEM AND DEVICE FOR PRODUCING ENERGY

(71) Applicant: Gary Loo, Toronto (CA)

(72) Inventor: Gary Loo, Toronto (CA)

( * ) Notice: Subject to any disclaimer, the term of this patent is extended or adjusted under 35 U.S.C. 154(b) by 0 days.

(21) Appl. No.: 14/015,297

(22) Filed: Aug. 30, 2013

(51) Int. Cl.
*F03B 13/00* (2006.01)
*F03B 17/00* (2006.01)

(52) U.S. Cl.
CPC ..... *F03B 17/005* (2013.01)
USPC ..... 290/54

(58) Field of Classification Search
USPC ..... 290/43, 54; 405/75
See application file for complete search history.

(56) References Cited

U.S. PATENT DOCUMENTS

| | | | |
|---|---|---|---|
| 3,970,859 | A | 7/1976 | Riem |
| 3,991,563 | A | 11/1976 | Pelin |
| 4,075,838 | A | 2/1978 | Pelin |
| 4,188,788 | A | 2/1980 | Eller |
| 4,443,707 | A | 4/1984 | Scieri et al. |
| 4,807,437 | A | 2/1989 | Pelin |
| 4,838,025 | A | 6/1989 | Nelis |
| 6,009,707 | A | 1/2000 | Alkhamis |
| 6,933,624 | B2 | 8/2005 | Beaston |
| 7,003,955 | B2 | 2/2006 | Davis |
| 7,656,051 | B2 | 2/2010 | Perin |
| 7,969,029 | B2 | 6/2011 | Vitagliano |
| 8,024,927 | B1 | 9/2011 | Azizi et al. |
| 2008/0159855 | A1 | 7/2008 | Spataro |
| 2009/0167031 | A1 | 7/2009 | Llewellyn |
| 2009/0230687 | A1 | 9/2009 | Robichaud |
| 2009/0235659 | A1 | 9/2009 | Lin |
| 2009/0302613 | A1 | 12/2009 | Ullman |
| 2011/0011086 | A1 | 1/2011 | Megaro |
| 2011/0187113 | A1* | 8/2011 | Loo ..... 290/54 |

(Continued)

FOREIGN PATENT DOCUMENTS

| | | | |
|---|---|---|---|
| CN | 2869363 | Y | 2/2007 |
| GB | 2430471 | A | 3/2007 |

(Continued)

OTHER PUBLICATIONS

The International Search Report and Written Opinion of the International Searching Authority corresponding to International Application No. PCT/CA2014/000639 dated Nov. 26, 2014. (8 pages).

*Primary Examiner* — Tulsidas C Patel
*Assistant Examiner* — Viet Nguyen
(74) *Attorney, Agent, or Firm* — Banner & Witcoff, Ltd.

(57) ABSTRACT

An energy producing unit is provided for producing energy from an artificial fall of fluid. The energy producing unit includes a host structure immersed in a fluid and a moveable member disposed within the host structure. The moveable member is independently vertically movable relative to the host structure between a risen position and a lowered position and is buoyantly biased to the risen position. An expandable compartment is formed within the host structure between a horizontal wall and a second horizontal member of the moveable member disposed below the horizontal wall. The expandable compartment expands and retracts when the moveable member is vertically moved between the risen position and the lowered position. The energy producing unit includes a conduit in communication with the expandable compartment and an energy extraction disposed within the conduit. As fluid flows through the conduit into the expandable compartment, energy is extracted from the flowing fluid.

21 Claims, 14 Drawing Sheets

(56) References Cited

U.S. PATENT DOCUMENTS

| | | | |
|---|---|---|---|
| 2011/0204645 | A1 | 8/2011 | Jacobson |
| 2012/0112472 | A1 | 5/2012 | Murray et al. |
| 2012/0117957 | A1 | 5/2012 | Travis |
| 2012/0119499 | A1 | 5/2012 | Kato |
| 2012/0200089 | A1 | 8/2012 | Deandrea et al. |

FOREIGN PATENT DOCUMENTS

| | | | |
|---|---|---|---|
| JP | S63176671 | A | 7/1988 |
| JP | H06280736 | A | 10/1994 |
| WO | 2004064221 | A2 | 7/2004 |
| WO | 2008128707 | A2 | 10/2008 |
| WO | 2009081433 | A1 | 7/2009 |
| WO | 2011008721 | A2 | 1/2011 |
| WO | 2011012731 | A1 | 2/2011 |
| WO | 2012034104 | A1 | 3/2012 |
| WO | 2012064877 | A2 | 5/2012 |
| WO | 2012085604 | A1 | 6/2012 |
| WO | 2012151388 | A1 | 11/2012 |

* cited by examiner

HYDRO-ELECTRIC SYSTEM AND DEVICE FOR PRODUCING ENERGY

FIELD OF THE INVENTION

This invention generally relates to an apparatus and system for producing energy. More specifically, to apparatuses and systems that utilize a falling volume of water to produce energy.

BACKGROUND OF THE INVENTION

Energy has been traditionally derived from the burning of fossil fuels, such as coal, oil and gas. However, an increasing demand for energy has resulted in the depletion of natural resources and increased cost for energy. Environmental concerns have also been raised over the release of harmful pollutants from using energy stored in fossil fuels. Nuclear power is another energy source, but there are concerns about safety and disposal of nuclear waste byproducts. Alternative sources of energy such as wind power and solar power are not presently believed to provide a cost effective and base load energy source on demand.

Hydro-electric energy is a safe, cost effective and renewable base load energy source. Hydro-electric power generation typically involves the use of falling water (either naturally occurring or dammed) to drive turbines which in turn drive generators to generate energy. However, the available sites in the world to utilize this resource have almost all been developed over the years.

Artificial falls of water may be created to mimic the capture of kinetic energy from falling water. Fallen water collected in artificial basins must be dispersed. However, energy is typically used to disperse the fallen water, which is inefficient. Water dispersion methods have been suggested such as the use of a pump, vacuum or water vaporization to remove the fallen water.

It would be desirable to provide an energy producing unit which requires less energy to disperse fallen water than that captured by the kinetic energy of the fallen water.

SUMMARY OF THE INVENTION

According to a first aspect of the invention, an energy producing unit is provided. A host structure is immersed in a main body of fluid. The host structure has at least one side wall open to the main body of fluid at a lower portion, and a horizontal wall having a horizontal wall valve. A chamber, having a bottom wall and at least one side wall, is fixed relative to the host structure. A moveable member has a first horizontal member disposed within the chamber, a second horizontal member disposed below the horizontal wall in the main body of fluid and at least one support connecting the horizontal members and passing through the horizontal wall. The moveable member is independently vertically movable relative to the host structure between a risen position and a lowered position. The moveable member is buoyantly biased to the risen position. The first horizontal member has a first horizontal member valve. The first horizontal member is disposed within the chamber to divide the chamber into an upper reservoir and a lower reservoir. When the first horizontal member valve is open, fluid may pass between the upper and lower reservoirs and when closed, prevents fluid communication between such reservoirs. An expandable compartment is formed between the at least one side wall of the host structure, the horizontal wall disposed at an upper portion of the expandable compartment and the second horizontal member of the moveable member. The expandable compartment expands and retracts when the second horizontal member of moveable member is vertically moved between the risen position and the lowered position. At least one side wall opening is disposed on the side wall of the host structure for permitting fluid located in the expandable compartment to flow into the main body of fluid. The side wall opening has a side wall opening valve for controlling the flow of the fluid into the main body of fluid. When the side wall opening valve is open, fluid may flow from the expandable compartment to the main body of fluid and when closed, the side wall opening valve prevents fluid communication. An inlet conduit has a lower end and an upper end. The inlet conduit passes through the at least one side wall of the host structure, and is open to the expandable compartment at the lower end and open to the exterior of the host structure at the upper end. The inlet conduit permits fluid located outside the host structure to flow into the expandable compartment. The inlet conduit has at least one inlet conduit valve for controlling the flow of the fluid into the expandable compartment. An energy extraction device is disposed within the inlet conduit to extract kinetic energy as fluid flows through the inlet conduit into the expandable compartment. An outlet conduit has a lower end and an upper end. The outlet conduit is in fluid communication with the lower reservoir at the lower end and in fluid communication to the upper reservoir at the upper end. The outlet conduit permits fluid located in the lower reservoir to flow into the upper reservoir.

When the moveable member is in the risen position, by opening the inlet conduit valve and horizontal wall valve, the expandable compartment fills with fluid. The moveable member sinks to the lowered position due to increased volume of the fluid in the expandable compartment and fluid in the lower reservoir flows into the upper reservoir via the outlet conduit. When the moveable member is in the lowered position, by closing the inlet conduit valve and horizontal wall valve, fluid flows from the expandable compartment to the main body of fluid by opening the side wall opening valve, and fluid flows from the upper reservoir to the lower reservoir by opening the first horizontal member valve, and the moveable member rises due to buoyant forces to the risen position.

The first horizontal member of the moveable member may have a first horizontal member fluid seal disposed between the first horizontal member and the chamber.

The second horizontal member of the moveable member may have a second horizontal member fluid seal disposed between the second horizontal member and the at least one side wall of the host structure.

The second horizontal member of the moveable member may have a second horizontal member valve to permit fluid located in the expandable compartment to flow into the main body of fluid, and control the flow of the fluid into the main body of fluid. When the second horizontal member valve is open, fluid may flow from the expandable compartment to the main body of fluid and when closed, prevents fluid communication.

A side conduit may be positioned in the side wall of the chamber in fluid communication with the lower reservoir at a lower end and in fluid communication to the upper reservoir at an upper end to permit fluid located in the upper reservoir to flow into the lower reservoir. The side conduit may have at least one side conduit valve to control the flow of the fluid into the lower reservoir. When the side conduit valve is open, fluid may flow from the upper reservoir to the lower reservoir and when closed, prevents fluid communication.

The moveable member may have at least one vertical wall disposed above the first horizontal member.

The outlet conduit may have at least one outlet conduit valve for controlling the flow of fluid into the upper reservoir.

A crane may be attached to the moveable member for controlling vertical movement of the moveable member in the risen position.

The energy producing unit may have a latch attached to the host structure for controlling vertical movement of the moveable member in the risen position.

The energy producing unit may have a counterweight attached to the moveable member to assist movement of the moveable member to the risen position.

The energy producing unit may have a motorized lift attached to the moveable member for controlling vertical movement of the moveable member.

The energy extraction device may be connected to a generator for generating electrical energy.

The side wall of the host structure may have at least one chamber wall duct to permit fluid communication between the chamber and the main body of fluid. The at least one chamber wall duct has a chamber wall duct valve to control fluid communication between the chamber into the main body of fluid. When the chamber wall duct valve is open, fluid is allowed and when closed, the chamber wall duct valve prevents fluid communication.

The host structure may have a bottom horizontal member forming a lower cavity below the moveable member. The bottom horizontal member has a bottom horizontal member valve to control the flow of fluid from the lower cavity into the main body of fluid. When the bottom horizontal member valve is open, fluid may pass between the lower cavity and the main body of fluid and when closed, prevents fluid communication.

The host structure may have a chamber horizontal member above the upper reservoir for permitting fluid located above the chamber horizontal member to flow into the upper reservoir, the chamber horizontal member having a chamber horizontal member valve for releasing fluid into the upper reservoir, such that when the chamber horizontal member valve is open, fluid may drain into the upper reservoir and when closed, the chamber horizontal member valve prevents fluid communication.

According to another aspect of the invention, an energy producing unit is provided. A host structure is immersed in a main body of fluid. The host structure has at least one side wall having openings to permit the main body of fluid to pass through the host structure, a bottom wall and a horizontal wall having a horizontal wall valve. A closed chamber containing chamber fluid is fixed relative to the host structure and disposed within the host structure. The chamber has a top wall, bottom wall and at least one side wall. A moveable member has first horizontal member disposed below the horizontal wall, a second horizontal member disposed within the closed chamber and at least one support connecting the members and passing through a scaled opening in the top wall of the chamber. The moveable member is independently vertically movable relative to the host structure between a risen position and a lowered position. The moveable member buoyantly biased to the risen position. The second horizontal member of the moveable member has a second horizontal member valve. The second horizontal member is disposed within the closed chamber to divide the closed chamber into an upper reservoir and a lower reservoir. When the second horizontal member valve is open, chamber fluid may pass between the lower and upper reservoirs and when closed, prevents fluid communication between such reservoirs. At least one latch located on the side wall of the host structure holds the moveable member in the risen position. An expandable compartment is formed within the host structure by the at least one side wall of the host structure, the horizontal wall and the first horizontal member of the moveable member. The expandable compartment expands and retracts when the first horizontal member of moveable member is vertically moved between the risen position and the lowered position. The first horizontal member of the moveable member has a first horizontal member valve for controlling fluid located in the expandable compartment to flow into the main body of fluid. When the first horizontal member valve is open, fluid may flow from the expandable compartment to the main body of fluid and when closed, the first horizontal member valve prevents fluid communication. An inlet conduit has a lower end and an upper end. The inlet conduit passes through the at least one side wall of the host structure, and is open to the upper portion of the expandable compartment at the lower end and open to the exterior of the host structure at the upper end. The inlet conduit permits fluid located outside the host structure to flow into the expandable compartment. The inlet conduit has at least one inlet conduit valve for controlling the flow of the fluid into the expandable compartment. An energy extraction device is disposed within the inlet conduit to extract kinetic energy as fluid flows through the inlet conduit into the expandable compartment. An outlet conduit has a lower end and an upper end. The outlet conduit is in fluid communication with the lower reservoir at the lower end and in fluid communication to the upper reservoir at the upper end. The outlet conduit permits fluid located in the lower reservoir to flow into the upper reservoir, and has at least one outlet conduit valve for controlling the flow of the fluid into the upper reservoir.

When the moveable member is in the risen position, by opening horizontal wall valve, the outlet conduit valve and the inlet conduit valve, the expandable compartment fills with fluid. The moveable member sinks to the lowered position due to increased weight of the fluid on the first horizontal member of the moveable member, and fluid in the lower reservoir flows into the upper reservoir. When the moveable member is in the lowered position, by closing the inlet conduit valve, horizontal wall valve and outlet conduit valve, and opening the first horizontal member valve and the second horizontal member valve, fluid flows from the expandable compartment to the main body of fluid via the first horizontal member valve, fluid flows from the upper reservoir to the lower reservoir, and the moveable member rises due to buoyant forces to the risen position.

The first horizontal member of the moveable member may have a first horizontal member fluid seal disposed between the first horizontal member and the at least one side wall of the host structure.

The second horizontal member valve of the moveable member may have a second horizontal member fluid seal disposed between the second horizontal member and the side of the chamber.

The energy producing unit may further comprise a counterweight attached to the moveable member to assist movement of the moveable member to the risen position.

According to another aspect of the invention, an energy producing structure is provided. The energy producing structure has at least two energy producing units.

DETAILED DESCRIPTION OF THE PREFERRED EMBODIMENTS

Figure 1:
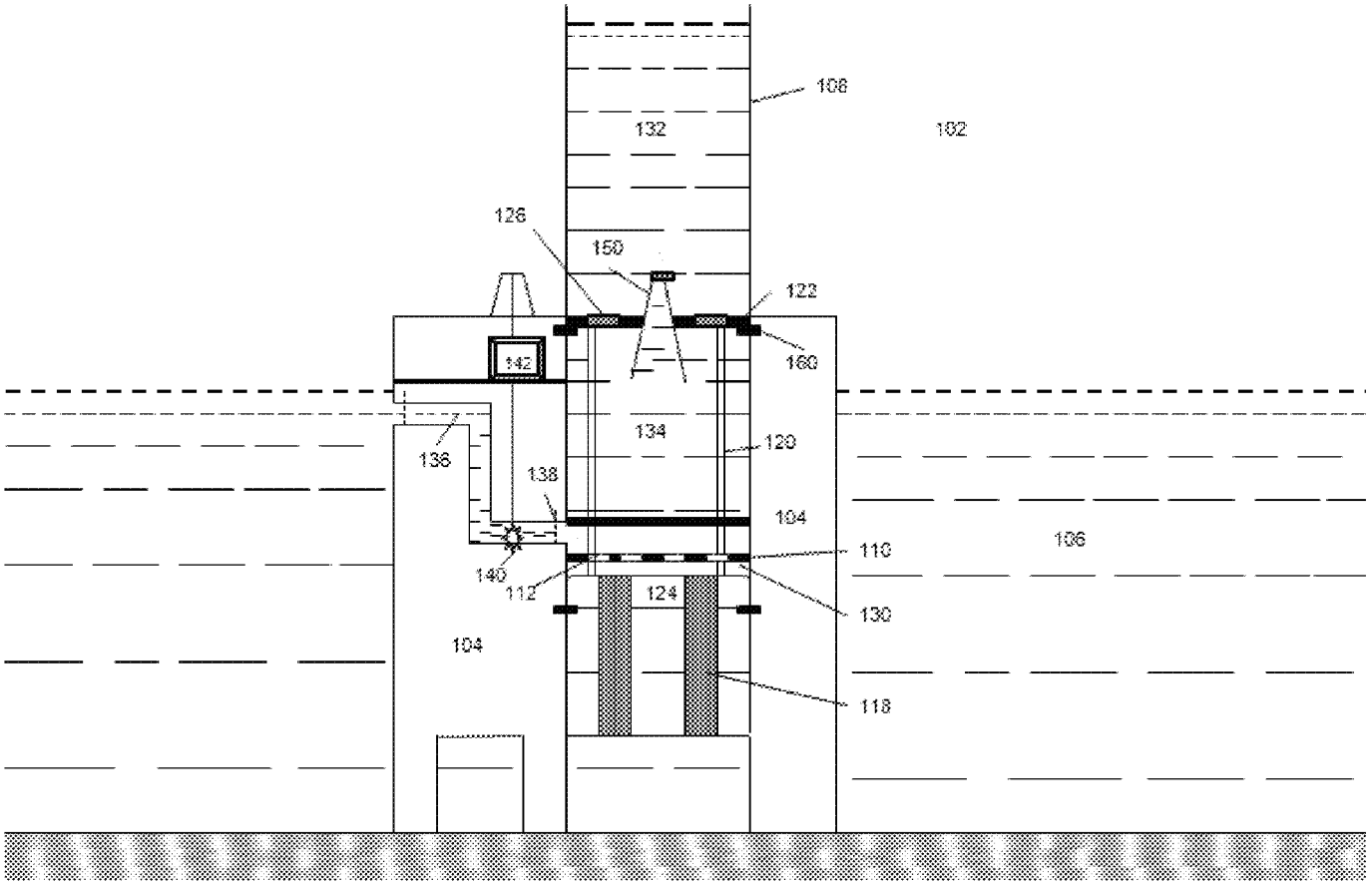
FIG. 1 is a cross-sectional side view of an energy producing unit at a first stage of an energy production cycle, in accordance with a first embodiment of the present invention.

An energy producing unit is provided to capture kinetic energy of falling fluid into an empty chamber. The fallen fluid is dispersed efficiently by using less energy than that captured by the extraction device. The extracted energy may be connected to a generator to produce electricity or serve as an energy source.

FIGS. 1 to 4 illustrate a cross-sectional view of an energy producing unit 102 at various stages of an energy production cycle according to one embodiment of the present invention. The energy producing unit 102 has a host structure 104 comprised of at least one sidewall and a horizontal wall 110. The host structure 104 is immersed in a fluid 106. The at least one side wall is open to the fluid at a lower portion. A chamber 108 comprised of a bottom wall and at least one side wall is fixed relative to the host structure 104.

A moveable member 120 is located within the host structure 104 and is independently vertically moveable relative to the host structure through a scaled opening in the horizontal wall 110. The moveable member 120 comprises a first horizontal member 122 positioned within the chamber 108, a second horizontal member 124 positioned below the horizontal wall 110. The first and second horizontal members are connected by at least one support. The first horizontal member 122 divides the chamber 108 into an upper reservoir 132 and a lower reservoir 134. The first horizontal member 122 includes a first horizontal member valve 126 to allow the fluid to flow from the upper reservoir 132 to the lower reservoir 134 when open, and prevent fluid communication when closed. Since the moveable member 120 is vertically movable, the size of the upper reservoir 132 and the lower reservoir 134 will vary with the vertical movement of the first horizontal member 122.

The vertically moveable first horizontal member 122 which is located within chamber 108 may include a first horizontal member seal therebetween extending around the perimeter of the first horizontal member 122. The first horizontal member 122 is adapted to prevent the seepage of fluid between the first horizontal member seal and the chamber 108, while the first horizontal member 122 remains vertically moveable. The first horizontal member seal may be constructed of any suitable material, such that the coefficient of friction between the first horizontal member seal and the chamber 108 is just sufficient to prevent fluid passage between the upper reservoir 132 and the lower reservoir 134 of the chamber but permit an almost unhindered vertical movement of the first horizontal member.

An expandable compartment 130 is formed between the at least one side wall of the host structure, the horizontal wall 110 and the second horizontal member 124 of the moveable member 120. The expandable compartment 130 expands and retracts when the moveable member 120 is vertically moved.

An inlet conduit 136 passes through a side wall of the host structure 104 connecting the expandable compartment 130 at a first end and with the main body of fluid at a second end to allow fluid to flow into the expandable compartment 130. A conduit valve 138 is attached to the inlet conduit 136 to control the flow of the fluid into the expandable compartment 130. The conduit valve 138 may be placed anywhere within the conduit 136. To improve control of fluid, a second conduit valve may be positioned at the mouth of the conduit.

In order to seal the fluid in the expandable compartment 130, the horizontal wall 110 which is fixed to the host structure includes a horizontal wall valve 112. The side wall of the host structure includes at least one side wall opening 118 to allow the fluid to flow from the expandable compartment to the main body of fluid, when open, and to trap fallen fluid in the expandable compartment 130 when closed. The second horizontal member of the moveable member may also include a second horizontal member valve for permitting fluid located in the expandable compartment to flow into the main body of fluid when open, and to trap fallen fluid in the expandable compartment 130 when closed.

The vertically moveable second horizontal member 124 located within the host structure may include a second horizontal member seal therebetween extending around the perimeter of the second horizontal member 124. The second horizontal member 124 is adapted to prevent the seepage of fluid between the second horizontal member seal and the side wall of the host structure, while the second horizontal member 124 remains vertically moveable. The second horizontal member seal may be constructed of any suitable material, such that the coefficient of friction between the second horizontal member seal and the side wall of the host structure is just sufficient to prevent fluid passage from the expandable compartment 130 to the main body of fluid but permit an almost unhindered vertical movement of the second horizontal member.

An outlet conduit 150 is in fluid communication with the lower reservoir 134 at a lower end and the upper reservoir 132 at an upper end. The outlet conduit 150 allows fluid to flow from the lower reservoir 134 to the upper reservoir 132. The outlet conduit 150 may include an outlet conduit valve to control the flow of fluid into the upper reservoir. The outlet conduit 150 may have a tapered or conical shape such that the top end of the outlet conduit is narrower than the bottom end. This may increase the pressure at which the water moves from the lower reservoir to the upper reservoir.

An energy extraction device 140 is positioned within the inlet conduit 136 to extract kinetic energy as the fluid flows through the inlet conduit 136 into the expandable compartment 130. The energy extraction device 140 may be a turbine or device for capturing kinetic energy. The energy extraction device 140 may be placed anywhere within the inlet conduit 136.

The energy extraction device 140 may be connected to a generator 142 for generating electricity. The energy extraction device 140 may also be connected to a device for direct energy consumption.

As shown in FIG. 1, when the expandable compartment 130 is empty, the moveable member 120 is buoyantly biased to a risen position and the second horizontal member 124 is immersed in the fluid. FIG. 1 illustrates a first stage of an energy production cycle. The inlet conduit valve 138 is closed which prevents fluid from entering the expandable compartment 130. The horizontal wall valve 112 is open and the first horizontal member valve 126 and side wall opening 118 is closed. The expandable compartment 130 is empty, the moveable member 120 is buoyantly biased to a risen position and the second horizontal member 124 is immersed in the fluid. By buoyantly biased, it is meant that the moveable member 120 is positively buoyant such that the upward buoyant force on the moveable member 120 is greater than the weight of fluid displaced by the moveable member 120. The density of the moveable member 120 may be adjusted by utilizing hollow construction of components of the moveable member 120.

The upper reservoir 132 containing fluid applies downward gravitational force on the moveable member 120 to permit the moveable member 120 to be positioned below the surface of the fluid.

For example, the downward gravitational force of the moveable member is approximately 16,000,000 N (assuming that the moveable member has 0.02 m thick steel walls, the first horizontal member has a width of 30 m, length of 30 m and height of 1 m, the second horizontal member has a width of 30 m, length of 30 m and height of 5 m, and the support has a width of 0.5 m, length of 75 m and height of 0.5 m).

To calculate the depth where the moveable member is neutrally buoyant, assume the surface area of the bottom of the moveable member is 900 $m^2$ (30 m×30 m), as follows:

$$\text{Pressure}=\text{Force}/\text{Area}$$

$$\text{Pressure}=16{,}000{,}000\ \text{N}/900\ \text{m}^2$$

$$\text{Pressure}=17.7\ \text{kPa}$$

Thus, the downward pressure exerted by the bottom wall of the moveable member is 17.7 kPa.

To calculate the equilibrium displacement depth of the moveable member when it is neutrally buoyant, it is known that at 100 m depth, the pressure of water is 1000 kPa, as follows:

$$\text{Displacement Depth}=(100\ \text{m}/1000\ \text{kPa})*17.7\ \text{kPa}$$

$$\text{Displacement Depth}=1.77\ \text{m}$$

Thus, if the gravitational pressure of the bottom wall of the moveable member is 17.7 kPa, the upward buoyant pressure of 17.7 kPa is at 1.77 meters depth from the surface. The moveable member is displaced at a depth of 1.77 m.

To calculate the gravitational force required to keep the second horizontal member 124 of the moveable member downwardly displaced at 30 m depth below the surface of the main body of fluid, it is known at that depth, the upward buoyant pressure of water is 300 kPa. Assuming the surface area of the bottom of the moveable member is 900 $m^2$ (30 m×30 m), the downward gravitational force needed to create 300 kPa is as follows:

$$\text{Force}=\text{Pressure}\times\text{Area}$$

$$\text{Force}=300\ \text{kPa}\times 900\ \text{m}^2$$

$$\text{Force}=270{,}000{,}000\ \text{N}$$

Thus, the downward gravitational force required to keep the moveable member displaced at a depth of 30 m is 270,000,000N.

To calculate the mass of 270,000,000N assume gravity is 9.81 $m/s^2$, as follows:

$$\text{Mass}=\text{Force}/\text{Gravity}$$

$$\text{Mass}=270{,}000{,}000\ \text{N}/9.81\ \text{m/s}^2$$

$$\text{Mass}=27{,}500{,}000\ \text{kg}$$

Thus, the mass required to downwardly displace the moveable member at a depth of 30 meters of fluid is 27,500,000 kg. Since the force required to downwardly displace the moveable member at a depth of 30 meters of fluid is 270,000,000 N and the force of the moveable member is 16,000,000 N, then an additional downward force of 254,000,000 N is necessary. Assuming that the water is used to provide the additional mass to downwardly displace the moveable member at 30 meters, then the mass of water is 26,000,000 kg (254,000,000 N/9.81 $m/s^2$) which is approximately 26,000 meters cubed volume of water (26,000,000 kg/density of water 1000 $kg/m^3$)

Figure 2:
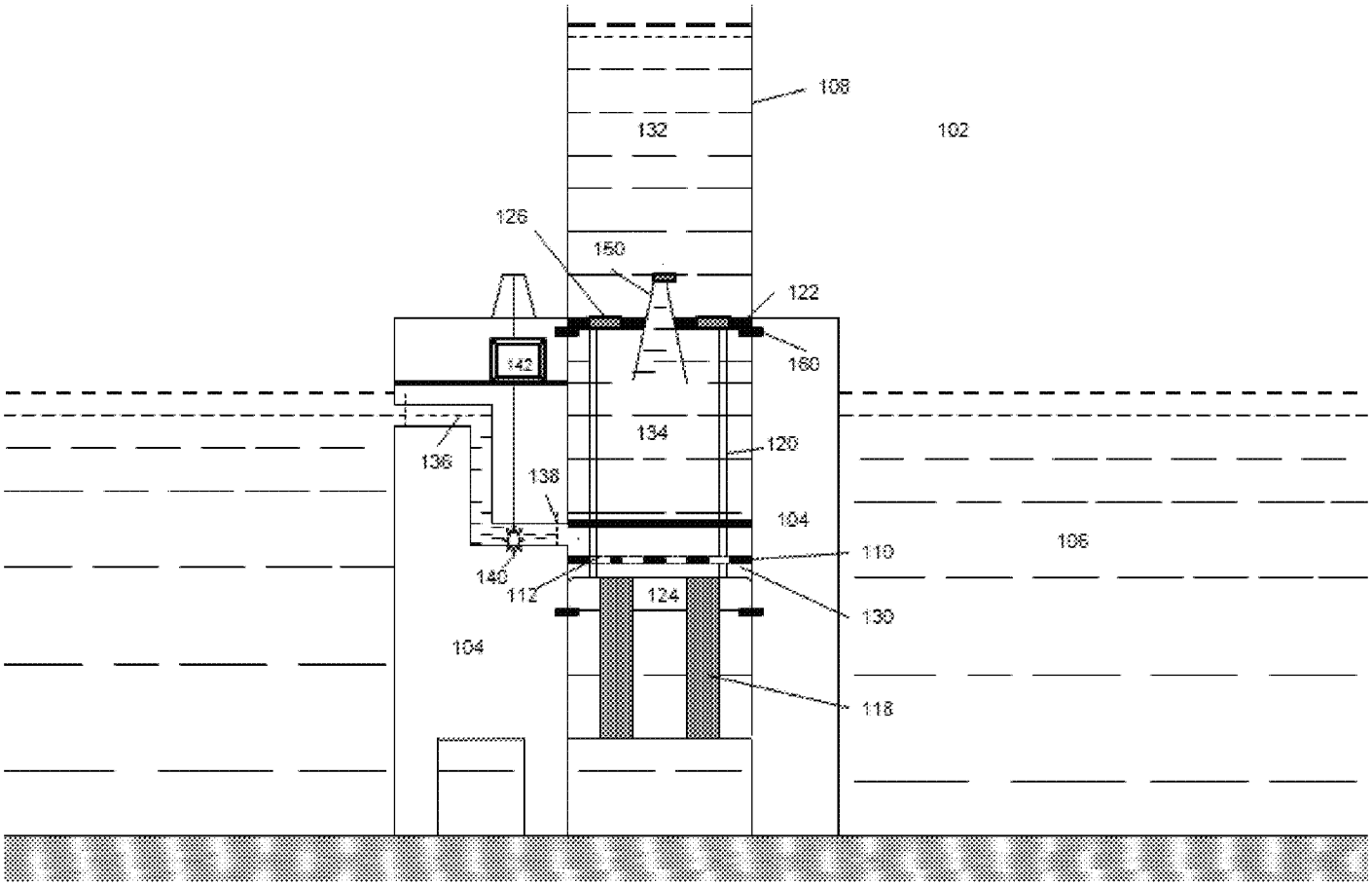
FIG. 2 is a cross-sectional side view of an energy producing unit at a second stage of an energy production cycle, in accordance with a first embodiment of the present invention.
Figure 3A:
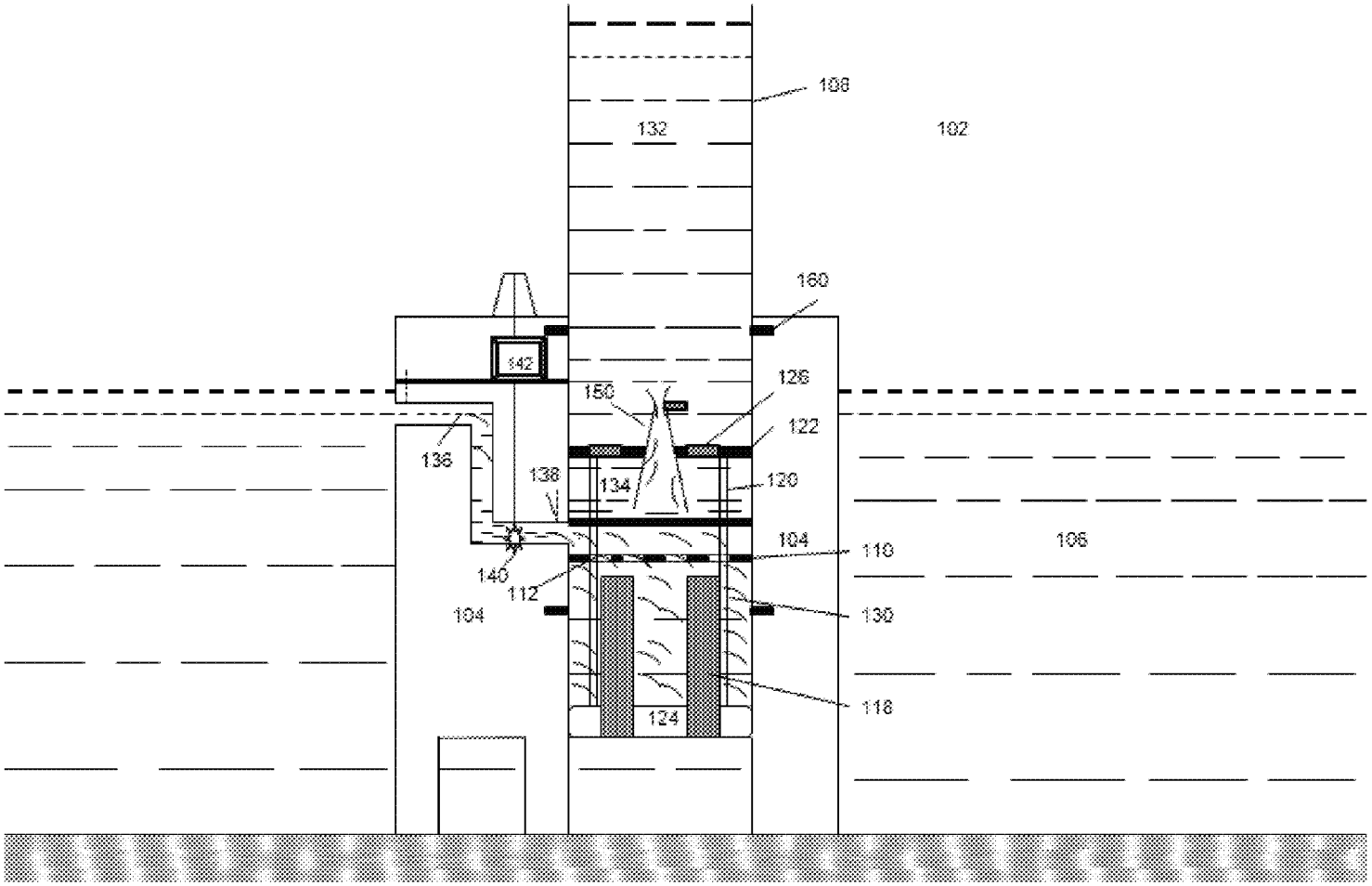
FIGS. 3A-3B are cross-sectional side views of an energy producing unit at a third stage of an energy production cycle, in accordance with a first embodiment of the present invention.

In a second stage of the energy production cycle, the inlet conduit valve 138 is opened allowing fluid to pass through the horizontal wall valve 112, and enter the expandable compartment 130. As fluid flows through the inlet conduit 136, the energy extraction device 140 captures the kinetic energy of the falling fluid. For example, the moving fluid may spin a turbine. As illustrated in FIG. 2, the fallen fluid enters and is trapped in the expandable compartment 130. The horizontal wall valve 112 remains open and the first horizontal member valve 126 and side wall opening 118 remain closed. As the weight of the moveable member 120 increases due to the fallen fluid, the moveable member 120 will sink deeper in the main body of fluid due to the forces of gravity. As the moveable member sinks to the lowered position, fluid in the lower reservoir 134 flows into the upper reservoir 132 via the outlet conduit 150 which increases the downward force of the moveable member to assist in the downward displacement of the moveable member 120. The moveable member 120 continues to sink until it reaches the lowered position, as illustrated in FIG. 3A.

For example, the fallen fluid is water having a volume of 27,000 $m^3$ (30 m*30 m*30 m). To calculate the mass of the fallen water, assume that the density of water is 1000 $kg/m^3$ and the volume of water is 27,000 $m^3$, as follows:

$$\text{Mass}=\text{Density}\times\text{Volume}$$

$$\text{Mass}=1000\ \text{kg/m}^3\times 27{,}000\ \text{m}^3$$

$$\text{Mass}=27{,}000{,}000\ \text{kg}$$

The mass of the fallen water is 27,000,000 kg.

To calculate the downward gravitational force of the fallen water, assume that gravity is 9.81 $m/s^2$ and the mass of the fallen water is 27,000,000 kg, as follows:

$$\text{Force}=\text{Mass}\times\text{Gravity}$$

$$\text{Force}=27{,}000{,}000\ \text{kg}\times 9.81\ \text{m/s}^2$$

$$\text{Force}=270{,}000{,}000\ \text{N (downward)}$$

Thus, the downward gravitational force of the fallen water is 270,000,000 N.

The volume of water that flows from the lower reservoir to the upper reservoir as the moveable member sinks to the lowered position is equivalent to the volume of fallen water. To calculate the combined downward gravitational force exerted by the bottom surface of the moveable member at the lowered position, add the gravitational force of each of the moveable member (16,000,000 N), the water in the upper reservoir 132 (254,000,000 N) required to downwardly displace the moveable member at 30 m, the fallen water in the expandable compartment (270,000,000 N) and the water that flows from the lower reservoir to the upper reservoir (270,000,000 N). Thus, a downward force of 810,000,000 N. The pressure exerted by the bottom of the moveable member is as follows:

Pressure=Force/Area

=810,000,000/900 m2

=900,000 Pa or 900 kPa

Thus, the moveable member has enough downward force to displace down to a depth of 90 meters which is where the upward buoyant pressure is also 900 kPa. There may be latches, stoppers or other devices to hold the moveable member at 60 meters depth (the lowered position).

Figure 3B:
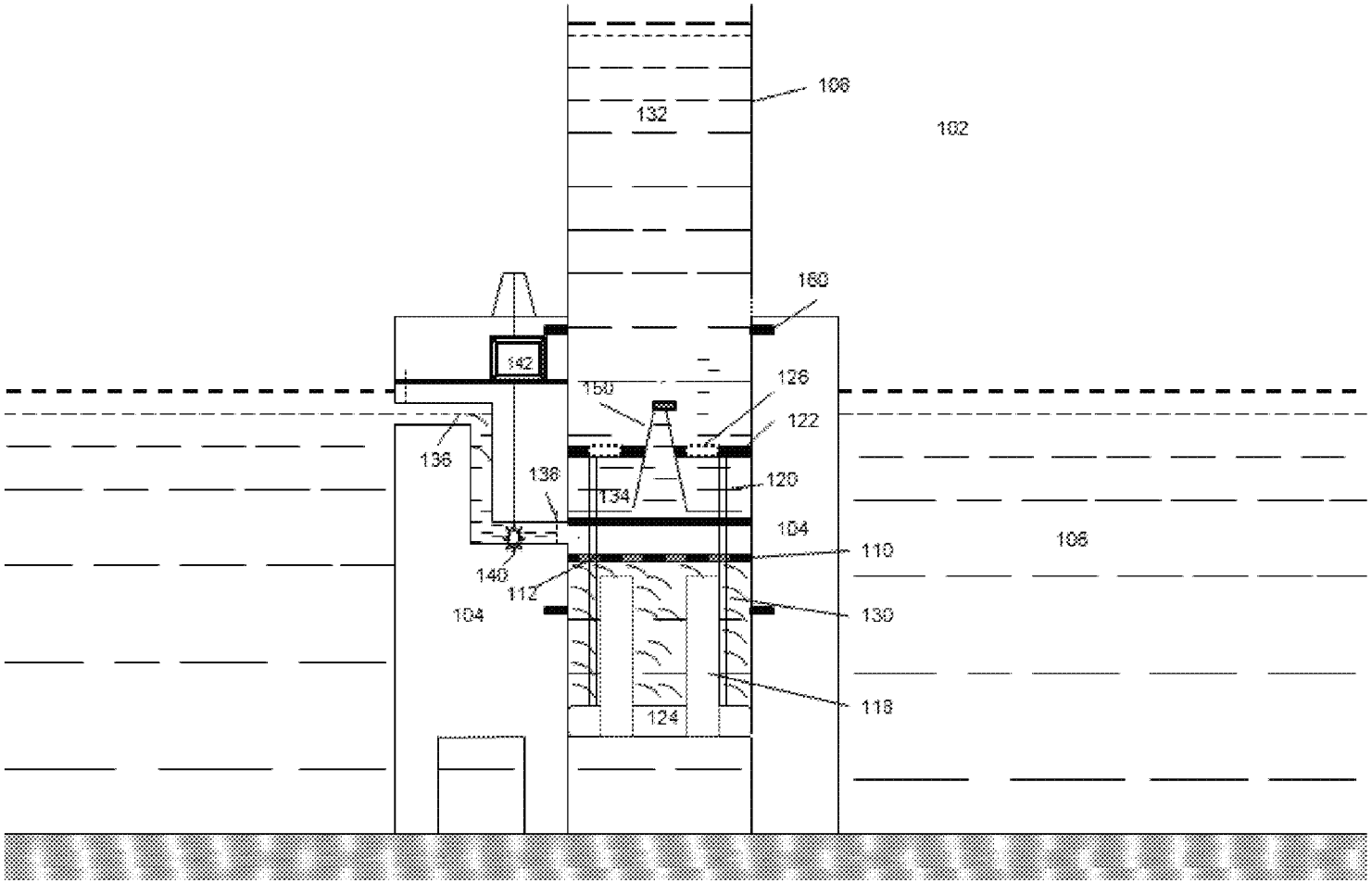

In a third stage of the energy production cycle, the moveable member 120 reaches the lowered position. As illustrated in FIG. 3B, once the moveable member 120 sinks to the lowered position, the inlet conduit valve 138 is closed which prevents further fluid from entering the expandable compartment 130. The horizontal wall valve 112 is closed to trap fluid in the expandable compartment 130 and the side wall opening 118 is opened to permit fluid trapped in the expandable compartment 130 to flow out into the main body of fluid. The first horizontal member valve 126 is opened to permit fluid in the upper reservoir 134 to flow into the lower reservoir 134 which reduces the downward gravitational force of the moveable member 120. Upward buoyant forces acting on the moveable member 120 assist fluid to flow out of the expandable compartment 130. The moveable member 120 is pushed upward by the buoyant forces which squeeze the fluid in the expandable compartment 130 between the horizontal wall 110 and the second horizontal member 124. Thus, the fluid in the expandable compartment 130 flows into the main body of fluid through the side wall opening 118. The upward buoyant pressure has the capacity to push the moveable member 120 upward to the risen position.

The upward buoyant pressure did not have the capacity before to push the moveable member to the risen position because with the side conduit valve and first horizontal member valve closed, the fluid in the expandable compartment and the upper reservoir behaved each as a singular mass bodies with no means for any of the fluid to flow out of their respective encased partitions. With the two valves open, the upward buoyant force will have the capacity to push up just the moveable member; the fluid in the expandable compartment will be forced out into the main body of fluid, and the fluid in upper reservoir will drain into the lower reservoir as the moveable member rises. In the risen position, with the first horizontal member valves closing, the fluid in the upper reservoir will again behave as a single body mass with no means of escape and will have the magnitude to exert enough downward gravitational force on the moveable member, to prevent the buoyant force from pushing higher.

Figure 4:
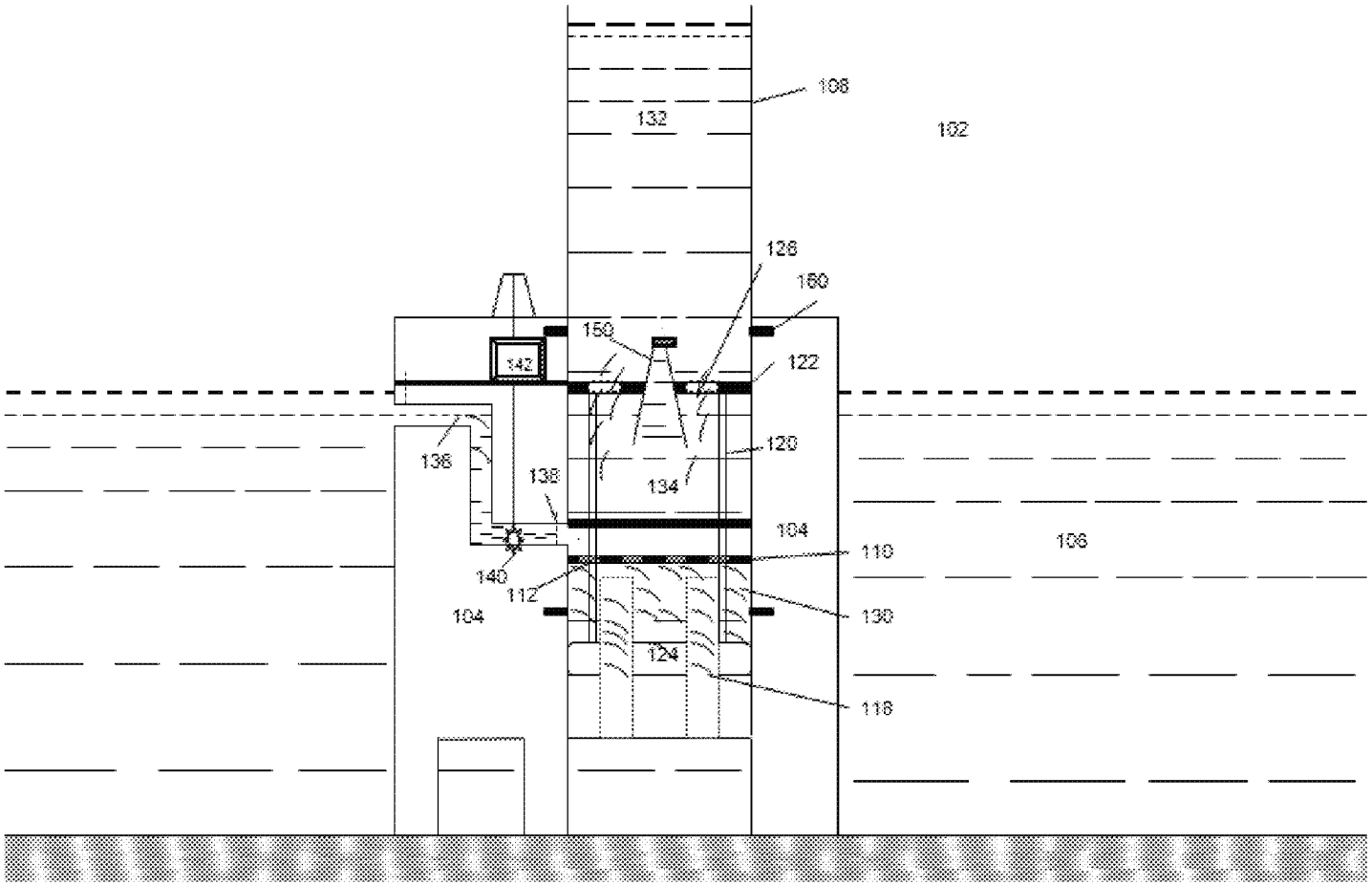
FIG. 4 is a cross-sectional side view of an energy producing unit at a fourth stage of an energy production cycle, in accordance with a first embodiment of the present invention.

FIG. 4 illustrates a fourth stage of the energy production cycle. As the fluid in the expandable compartment 130 flows out, the moveable member 120 rises to the risen position and returns to the first stage. The side wall opening 118, inlet conduit valve 138, and first horizontal member valve 126 are closed. The horizontal wall valve 112 is re-opened. The energy producing unit 102 is ready to start another energy production cycle.

Controls may be provided to open and close the valves of the present invention.

To limit vertical movement of the moveable member 120, a latch 160 may be provided on the side wall of the host structure. One or more latches 160 are positioned to maintain the second horizontal member 124 immersed in the fluid when the moveable member 120 is in the risen position. A latch may also be useful to limit displacement of the moveable member at the lowered position.

Because wind, waves or other forces may hamper vertical movement of the moveable member 120, a lift may be provided to control vertical movement of the moveable member 120. A motorized lift may be useful to hold the moveable member 120 in the risen position or to assist the moveable member 120 to vertically move from the lowered position to the risen position. The lift may be useful for maintenance purposes or where unforeseen variables may temporarily hinder the upward movement of the moveable member. The motorized lift may be powered by a power source.

The energy producing unit of the present invention may include a counterweight to provide an upward force on the moveable member. A counterweight can be applied to the moveable member to lift the moveable member by either pulling it up or pushing it up. The counterweight derives its upward force using gravity as the source and the direction is converted to an upward direction and applied onto the moveable member. The counterweight's gravitational pull will be used in conjunction with simple machines such as a pulley, lever, wheel and axle, or any combination of these. The machines may use the counterweight with a mechanical advantage or no mechanical advantage. As well, the counterweight can be used on any hydraulic or pneumatic system, with or without a mechanical advantage, to force the moveable member back up. The counterweight's upward force is always applied to the moveable member at every stage of the energy creation cycle.

A crane may be attached to the moveable member for controlling vertical movement of the moveable member in the risen position. One possible arrangement of a crane 164 is shown in FIG. 5.

The magnitude of the force created by the counterweight can be used in combination with the upward buoyant force or be large enough to obviate the need for a buoyant force. Any combination in a ratio can be used to offset the downward gravitation force of the moveable member and effectively make the moveable member weightless. Some ratio examples are given:

| Set up | 1 | 2 | 3 | 4 |
|---|---|---|---|---|
| Moveable member gravity | 100 N (down) | 100 N (down) | 100 N (down) | 100 N (down) |
| Buoyant force | 100 N (up) | 50 N (up) | 10 N (up) | 0 N |
| Counterweight force | 0 N | 50 N (up) | 90 N (up) | 100 N (up) |

Figure 5:
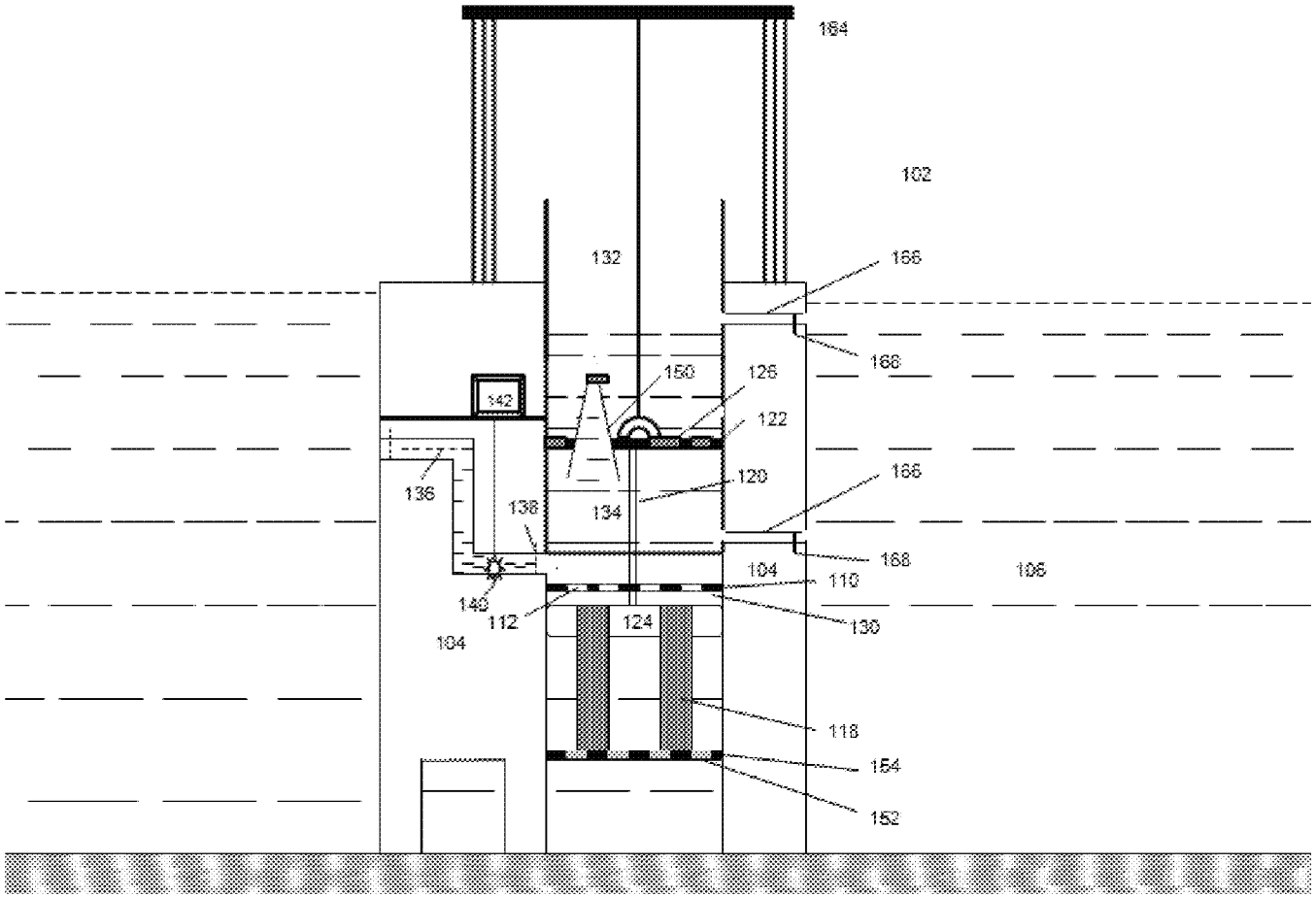
FIG. 5 is a cross-sectional side view of an energy producing unit, in accordance with a first embodiment of the present invention.

As shown in FIG. 5, a chamber wall duct 166 having a chamber wall valve 168 may be positioned in the side wall of the host structure to allow fluid communication between the chamber and the main body of fluid, when open, and to prevent fluid communication when closed.

A second horizontal wall 152 having a second horizontal wall valve 154 may be positioned below the expandable compartment 130 to allow the fluid to flow from the expandable compartment to the main body of fluid, when open, and to trap fallen fluid in the expandable compartment 130 when closed. The second horizontal wall 152 is also useful for maintenance or repairs to isolate the main body of fluid from the moveable member and the expandable compartment.

Figure 6:
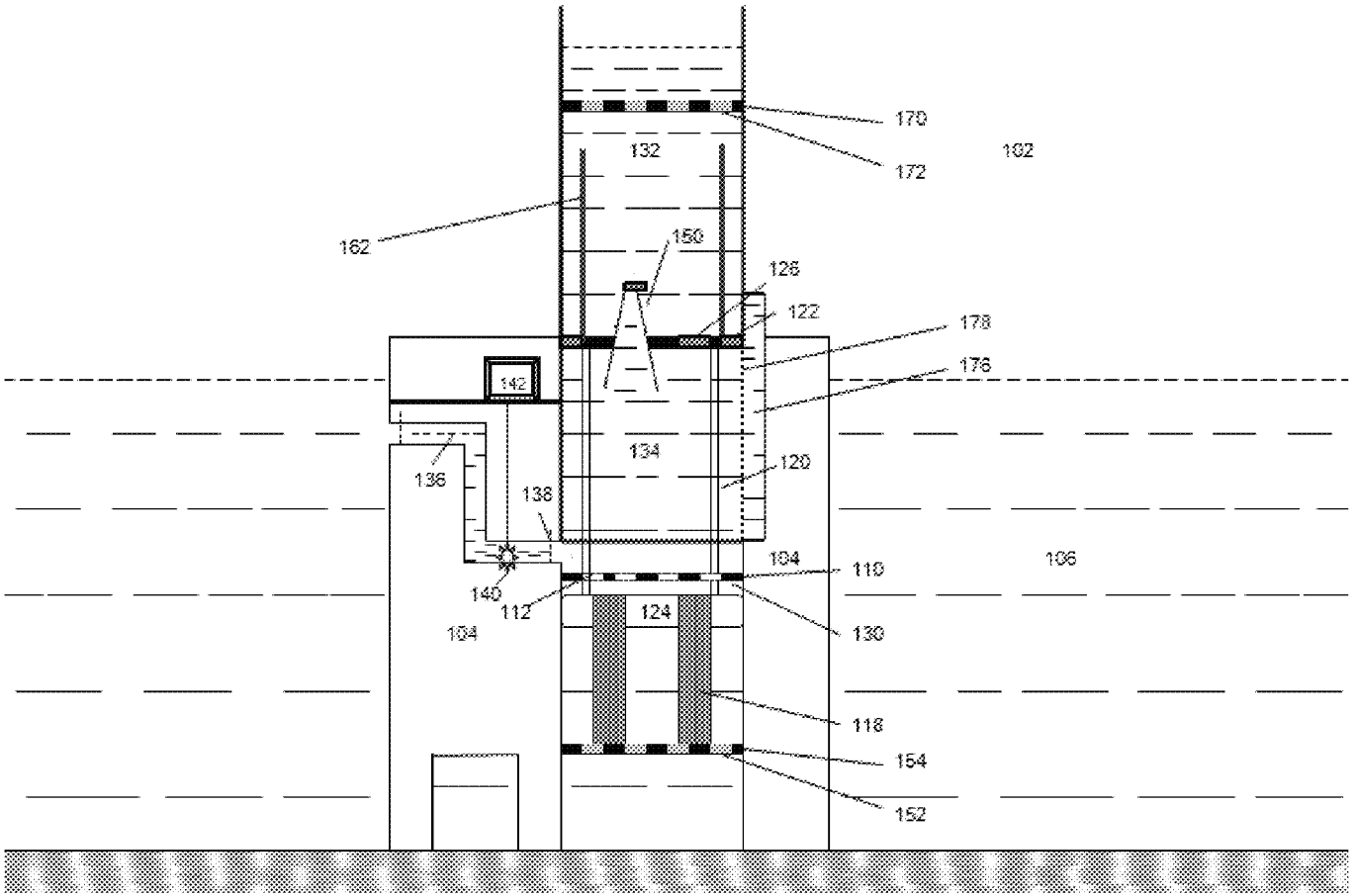
FIG. 6 is a cross-sectional side view of an energy producing unit, in accordance with a first embodiment of the present invention.

Referring to FIG. 6, a vertical wall 162 may be positioned in the upper reservoir 132 above the first horizontal member 122. The vertical wall 162 forms a chamber on top of the moveable member to confine fluid. Thus, fluid may be confined without needing the horizontal member wall to be in contact with the chamber wall as previously shown.

A chamber horizontal member 170 having a chamber wall valve 172 may be positioned above the upper reservoir 132 in the chamber 108 to allow the fluid to flow into the upper reservoir, when open, and to prevent communication with the upper reservoir 132 when closed.

A side conduit 176 may be positioned outside the chamber in fluid communication with the chamber. The side conduit has at least one side conduit valve 178 to control the flow of fluid between the chamber and the side conduit 176 such that when the side conduit valve 178 is open, allows fluid communication and when closed, prevents fluid communication.

The fluid 106 may be water.

FIGS. 7 to 10 illustrate two other possible embodiments of the energy producing unit.

Figure 7:
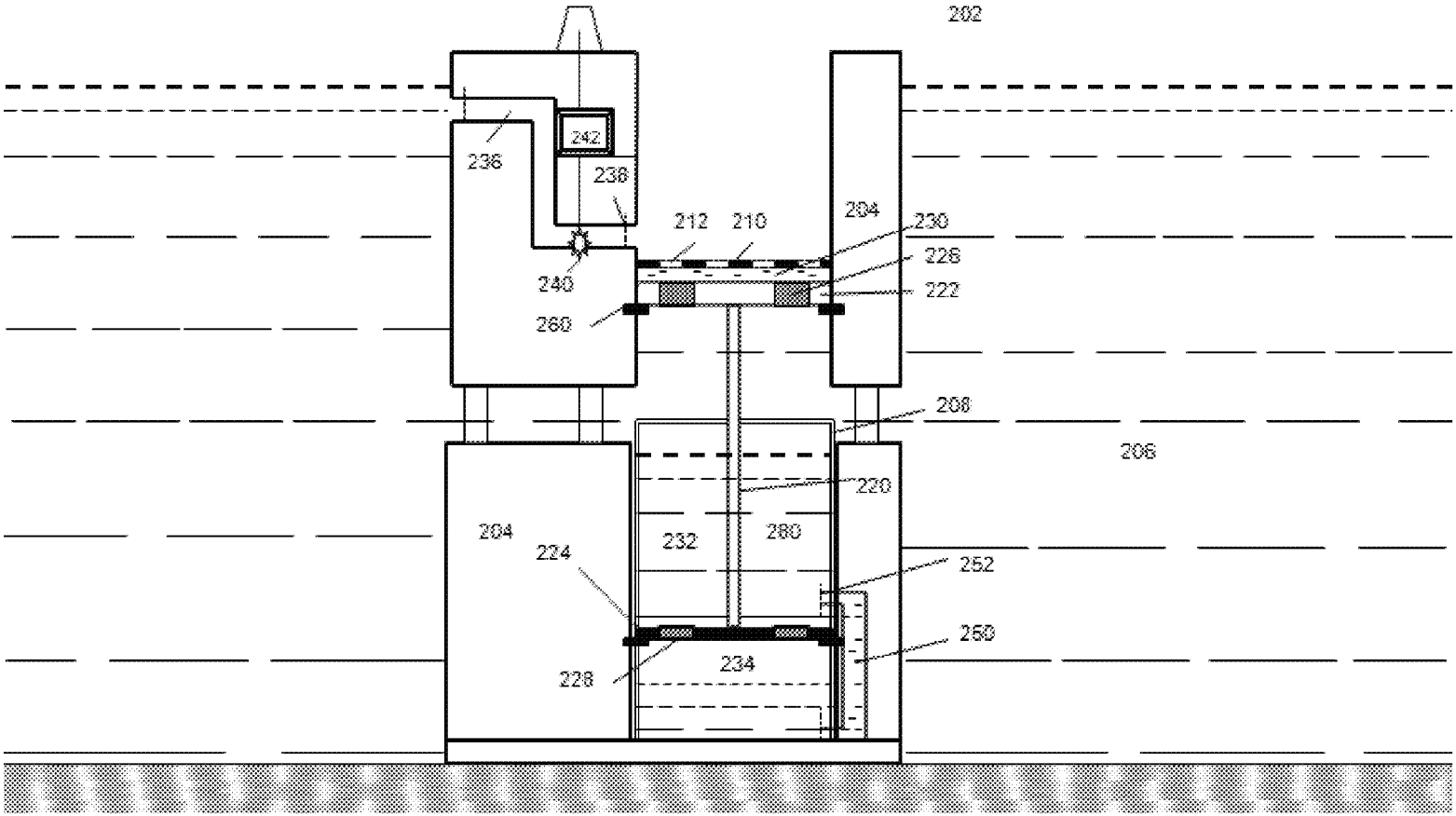
FIG. 7 is a cross-sectional side view of an energy producing unit at a first stage of an energy production cycle, in accordance with a second embodiment of the present invention.

FIG. 7 shows a cross-sectional view of an energy producing unit 202 according to a second embodiment of the present invention. The energy producing unit 202 has a host structure 204 comprised of at least one sidewall, a bottom wall and a horizontal wall 210. The host structure 204 is immersed in a fluid 206. The at least one side wall has openings to permit the fluid to pass through the host structure 204. A closed chamber 208 comprised of a top wall, a bottom wall and at least one side wall is fixed relative to the host structure 204. The closed chamber 208 contains chamber fluid 280.

A moveable member 220 is located within the host structure and is independently vertically moveable relative to the host structure. The moveable member 220 comprises a first horizontal member 222 positioned below the horizontal wall 210 and a second horizontal member 224 disposed within the closed chamber 208. The first and second horizontal members are connected by at least one support. To limit vertical movement of the moveable member 220, a latch 260 may be provided on the side wall of the host structure. One or more latches 260 are positioned to maintain the moveable member 220 in the risen position.

The second horizontal member 224 divides the closed chamber 208 into an upper reservoir 232 and a lower reservoir 234. The second horizontal member 224 includes a second horizontal member valve 228 to allow the chamber fluid 280 to flow from the upper reservoir 232 to the lower reservoir 234 when open, and prevent fluid communication when closed.

The vertically moveable second horizontal member 224 which is located within the closed chamber wall 208 may include a second horizontal member seal therebetween extending around the perimeter of the second horizontal member 224. The second horizontal member 224 is adapted to prevent the seepage of chamber fluid 280 between the second horizontal member seal and the closed chamber 208, while the second horizontal member 224 remains vertically moveable. The second horizontal member seal may be constructed of any suitable material, such that the coefficient of friction between the second horizontal member seal and the chamber 208 is just sufficient to prevent chamber fluid 280 passage between the upper reservoir 232 and the lower reservoir 234 of the closed chamber but permit an almost unhindered vertical movement of the second horizontal member.

An expandable compartment 230 is formed between the at least one side wall of the host structure, the horizontal wall 210 and the first horizontal member 222 of the moveable member 220. The expandable compartment 230 expands and retracts when the moveable member 220 is vertically moved.

An inlet conduit 236 passes through a side wall of the host structure 204 connecting the expandable compartment 230 at a first end with the main body of fluid at a second end to allow fluid to flow into the expandable compartment 230. A conduit valve 238 is attached to the inlet conduit 236 to control the flow of the fluid into the expandable compartment 230. The conduit valve 238 may be placed anywhere within the conduit 236. To improve control of fluid, a second conduit valve may be positioned at the mouth of the conduit.

In order to seal the fluid in the expandable compartment 230, the horizontal wall 210 which is fixed within the host structure 204 includes a horizontal wall valve 212. The first horizontal member 222 includes at least one first horizontal member valve 226 to allow the fluid to flow from the expandable compartment to the main body of fluid, when open, and to trap fallen fluid in the expandable compartment 230 when closed.

The vertically moveable first horizontal member 222 located within the host structure may include a first horizontal member seal therebetween extending around the perimeter of the first horizontal member 222. The first horizontal member 222 is adapted to prevent the seepage of fluid between the first horizontal member seal and the side wall of the host structure, while the first horizontal member 222 remains vertically moveable. The first horizontal member seal may be constructed of any suitable material, such that the coefficient of friction between the second horizontal member seal and the side wall of the host structure is just sufficient to prevent fluid passage from the expandable compartment 230 to the main body of fluid but permit an almost unhindered vertical movement of the first horizontal member.

An outlet conduit 250 is in fluid communication with the lower reservoir 234 at a lower end and the upper reservoir 232 at an upper end. The outlet conduit 250 allows fluid to flow from the lower reservoir 234 to the upper reservoir 232. The outlet conduit 250 may include an outlet conduit valve to control the flow of fluid into the upper reservoir. The outlet conduit 250 may be positioned within the host structure as shown in FIGS. 7 to 10, or may be disposed on the moveable member and pass through the second horizontal member. The outlet conduit 250 may have a tapered or conical shape such that the top end of the outlet conduit is narrower than the bottom end. This may increase the pressure at which the water moves from the lower reservoir to the upper reservoir.

An energy extraction device 240 is positioned within the inlet conduit 236 to extract kinetic energy as the fluid flows through the inlet conduit 236 into the expandable compartment 230. The energy extraction device 240 may be a turbine or device for capturing kinetic energy. The energy extraction device 240 may be placed anywhere within the inlet conduit 236.

The energy extraction device 240 may be connected to a generator 242 for generating electricity. The energy extraction device 240 may also be connected to a device for direct energy consumption.

As shown in FIG. 7, when the expandable compartment 230 is fully contracted, the moveable member 220 is buoyantly biased to a risen position and held in the risen position by at least one latch 260. FIG. 7 illustrates a first stage of an energy production cycle. The inlet conduit valve 238 is closed which prevents fluid from entering the expandable compartment 230. The at least one horizontal wall valve 212 is open and the at least one first horizontal member valve 226, at least one second horizontal member valve 228 and at least one outlet conduit valve 252 are closed. The expandable compartment 230 is fully contracted and the moveable member 220 is buoyantly biased to a risen position. By buoyantly biased, it is meant that the moveable member 220 is positively buoyant such that the upward buoyant force on the moveable member 220 is greater than the weight of fluid displaced by the moveable member 220. The density of the moveable member 220 may be adjusted by utilizing hollow construction of components of the moveable member 220.

The upper reservoir 232 containing chamber fluid 280 applies downward gravitational force on the second horizontal member 224 to permit the moveable member 220 to be positioned below the surface of the fluid.

Figure 8:
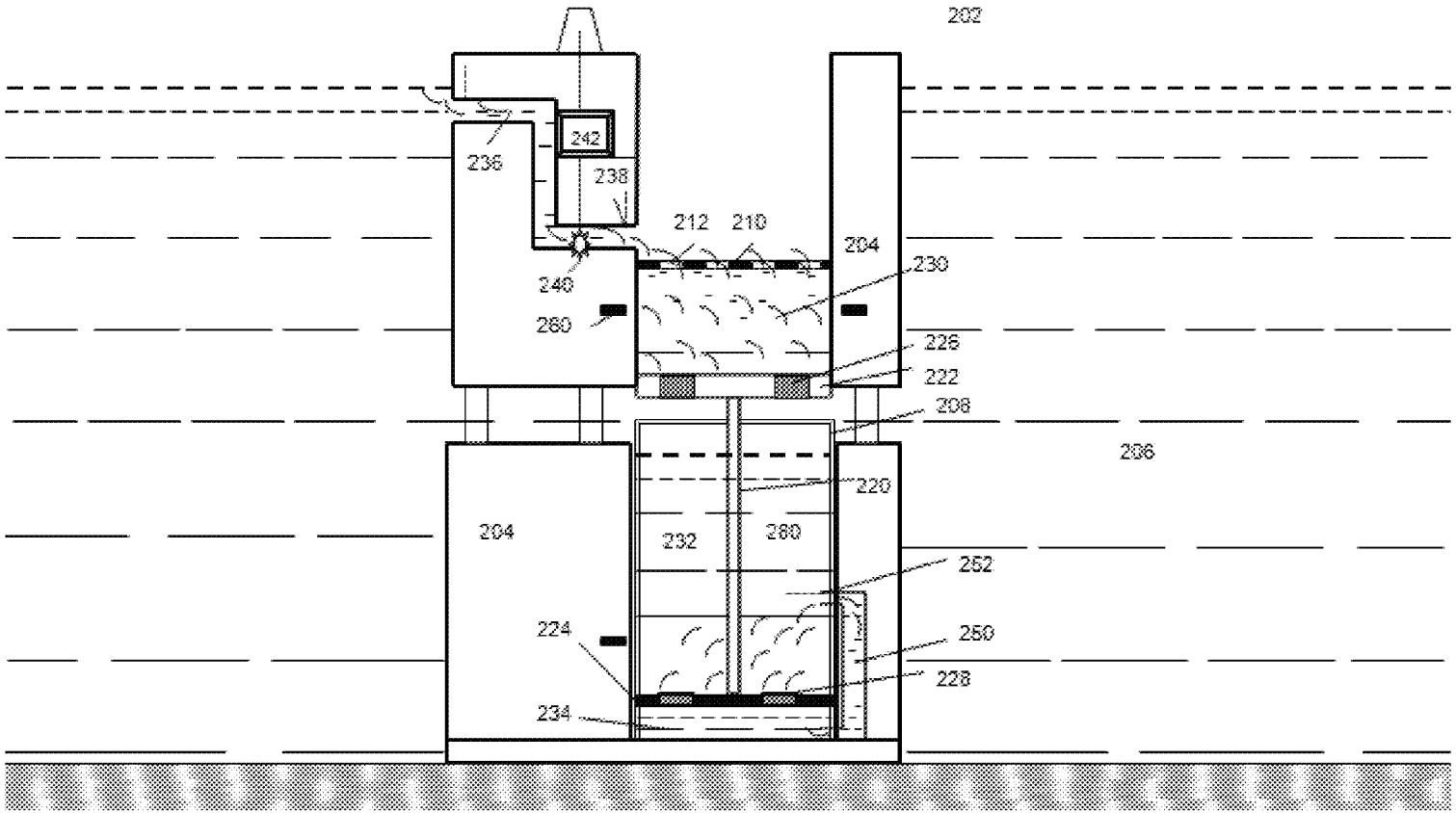
FIG. 8 is a cross-sectional side view of an energy producing unit at a second stage of an energy production cycle, in accordance with a second embodiment of the present invention.
Figure 9A:
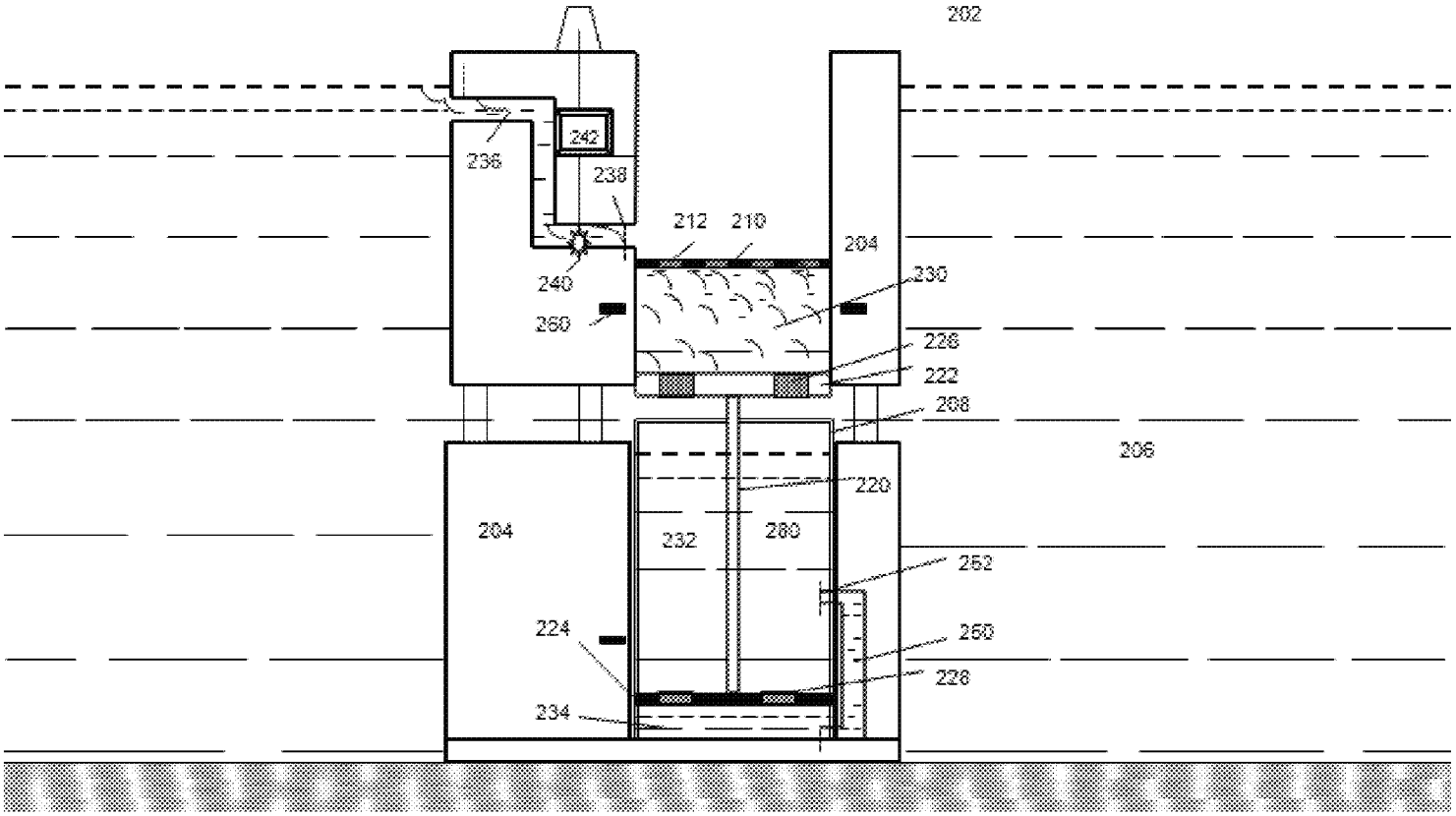
FIGS. 9A-9B are cross-sectional side views of an energy producing unit at a third stage of an energy production cycle, in accordance with a second embodiment of the present invention.

In a second stage of the energy production cycle, the inlet conduit valve 238 and horizontal wall valve 212 are opened allowing fluid to enter the expandable compartment 230. As fluid flows through the inlet conduit 236, the energy extraction device 240 captures the kinetic energy of the falling fluid. For example, the moving fluid may spin a turbine. As illustrated in FIG. 8, the fallen fluid enters the expandable compartment 230 through the horizontal wall valve 212 and is trapped in the expandable compartment 230. The horizontal wall valve 212 remains open and the first horizontal member valve 226 and second horizontal member valve 228 remain closed. The latch 260 is released to permit vertical movement of the moveable member and the outlet conduit valve 252 is opened. As the weight of the moveable member 220 increases due to the fallen fluid, the moveable member 220 will sink in the fluid due to the forces of gravity. As the moveable member sinks to the lowered position, chamber fluid 280 in the lower reservoir 234 flows into the upper reservoir 232 via the outlet conduit 250 which increases the downward force of the moveable member to assist in the downward displacement of the moveable member 220. The moveable member 220 continues to sink until it reaches the lowered position, as illustrated in FIG. 9A.

Figure 9B:
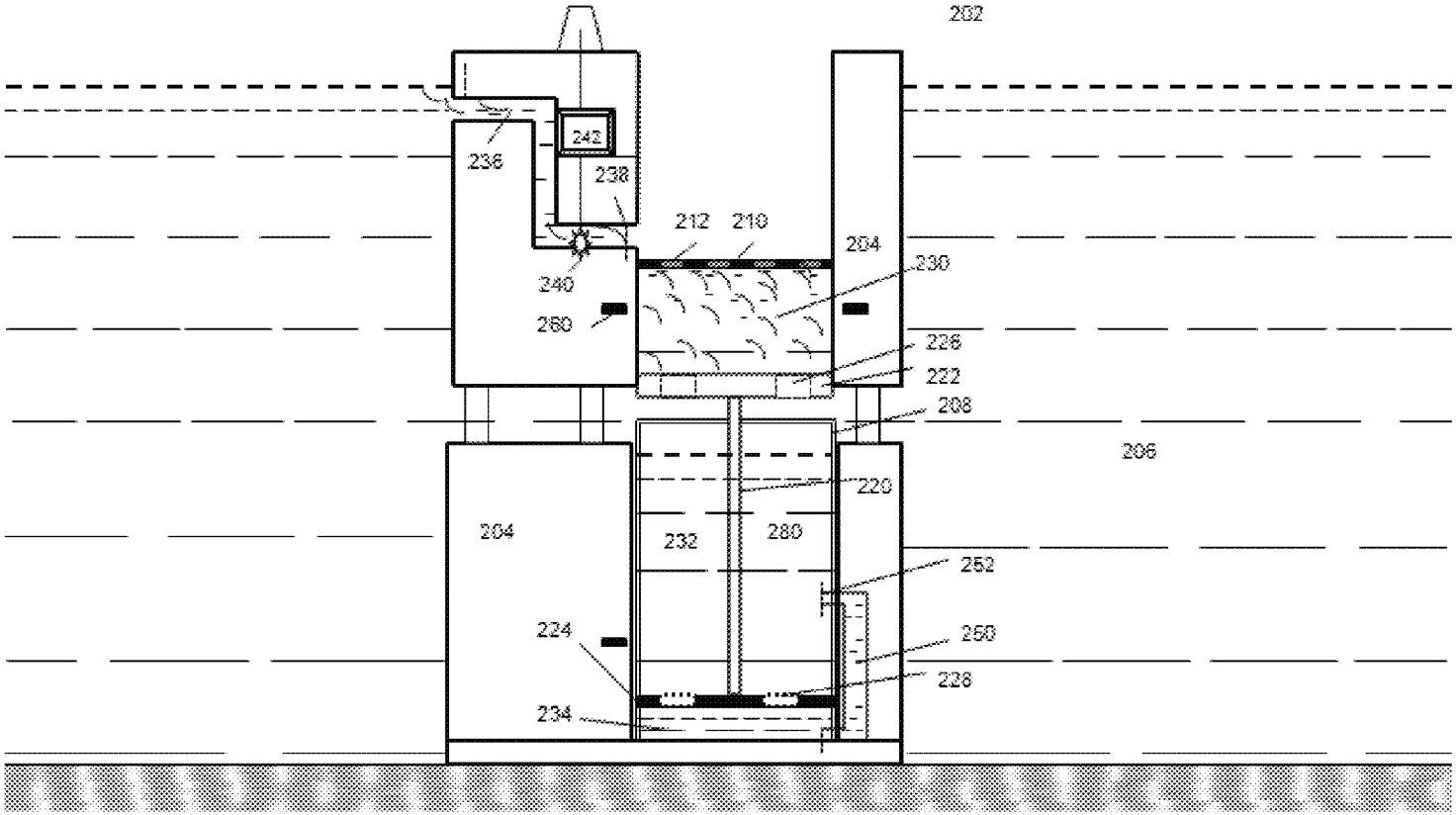

In a third stage of the energy production cycle, the moveable member 220 reaches the lowered position. As illustrated in FIG. 9B, once the moveable member 220 sinks to the lowered position, the inlet conduit valve 238 is closed which prevents further fluid from entering the expandable compartment 230. The horizontal wall valve 212 is closed to trap fluid in the expandable compartment 230 and the outlet conduit valve 252 is closed to prevent fluid communication between the lower reservoir 234 and the upper reservoir 232. The first horizontal member valve 226 is opened to permit fluid trapped in the expandable compartment 230 to flow out into the main body of fluid below. The second horizontal valve member 228 is opened to permit chamber fluid in the upper reservoir 232 to flow into the lower reservoir 234 which reduces the downward gravitational force of the moveable member 220. Upward buoyant forces acting on the moveable member 220 assist fluid to flow out of the expandable compartment 230. The moveable member 220 is pushed upward by the buoyant forces which squeeze the fluid in the expandable compartment 230 between the horizontal wall 210 and the first horizontal member 222. Thus, the fluid in the expandable compartment 230 flows into the main body of fluid through the first horizontal member valve 226. The upward buoyant pressure has the capacity to push the moveable member 220 upward to the risen position.

The upward buoyant pressure did not have the capacity before to push the moveable member to the risen position because with the side conduit valve and first horizontal member valve closed, the fluid in the expandable compartment and the upper reservoir behaved each as a singular mass bodies with no means for any of the fluid to flow out of their respective encased partitions. With the two valves open, the upward buoyant force will have the capacity to push up just the moveable member; the fluid in the expandable compartment will be forced out into the main body of fluid, and the fluid in upper reservoir will drain into the lower compartment as the moveable member rises. In the risen position, with the first and second horizontal member valves closing, the fluid in the upper reservoir will again behave as a single body mass with no means of escape and will have the magnitude to exert enough downward gravitational force on the moveable member, to prevent the buoyant force from pushing higher.

Figure 10:
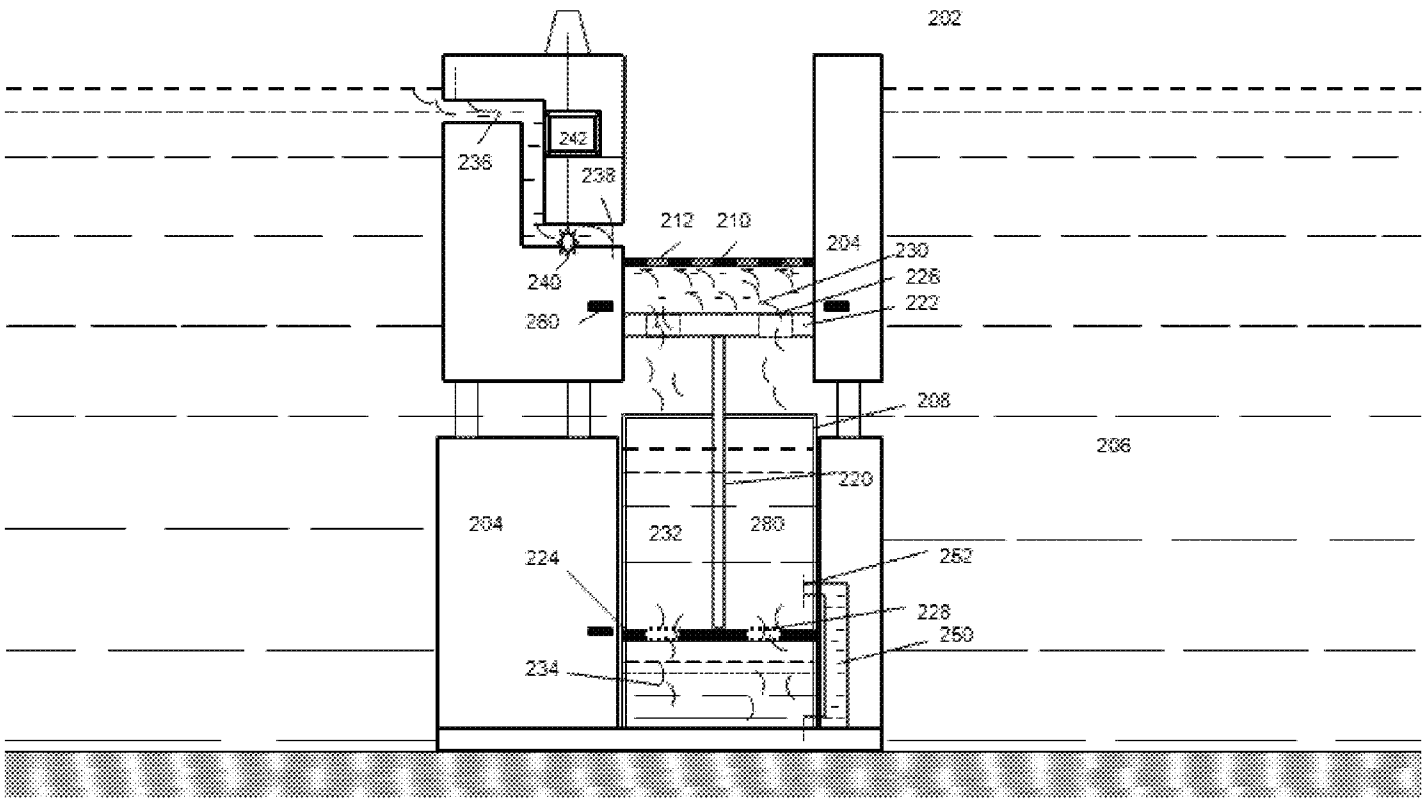
FIG. 10 is a cross-sectional side view of an energy producing unit at a fourth stage of an energy production cycle, in accordance with a second embodiment of the present invention.

FIG. 10 illustrates a fourth stage of the energy production cycle. As the fluid in the expandable compartment 230 flows out, the moveable member 220 rises to the risen position and returns to the first stage. The first horizontal member valve, outlet conduit valve and second horizontal member valve are closed. The energy producing unit 202 is ready to start another energy production cycle.

Controls may be provided to open and close the valves of the present invention.

Because wind, waves or other forces may hamper vertical movement of the moveable member 220, a motorized lift may be provided to control vertical movement of the moveable member 220. A motorized lift may be useful to hold the moveable member 220 in the risen position or to assist the moveable member 220 to vertically move from the lowered position to the risen position. The motorized lift may be useful for maintenance purposes or where unforeseen variables may temporarily hinder the upward movement of the moveable member. The motorized lift may be powered by a power source.

Figure 11:
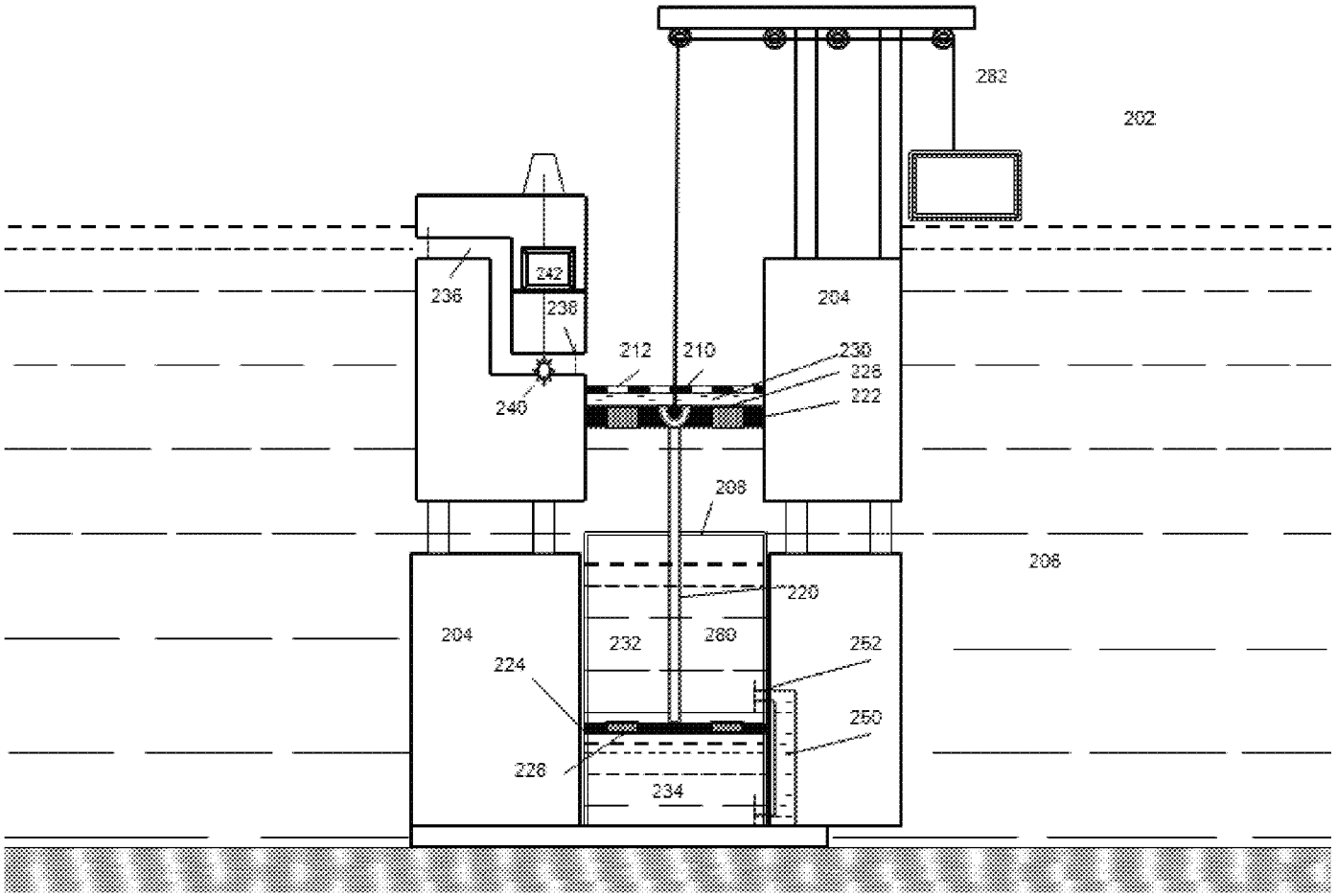
FIG. 11 is a cross-sectional side view of an energy producing unit, in accordance with a third embodiment of the present invention.

The energy producing unit of the present invention may include a counterweight may to provide an upward force on the moveable member. A counterweight can be applied to the moveable member to lift the moveable member by either pulling it up or pushing it up. The counterweight derives its upward force using gravity as the source and the direction is converted to an upward direction and applied onto the moveable member. The counterweight's gravitational pull will be used in conjunction with simple machines such as a pulley, lever, wheel and axle, or any combination of these. The machines may use the counterweight with a mechanical advantage or no mechanical advantage. As well, the counterweight can be used on any hydraulic or pneumatic system, with or without a mechanical advantage, to force the moveable member back up. The counterweight's upward force is always applied to the moveable member at every stage of the energy creation cycle. One possible arrangement of a pulley counterforce 282 is shown in FIG. 11.

The magnitude of the force created by the counterweight can be used in combination with the upward buoyant force or be large enough to obviate the need for a buoyant force. Any combination in a ratio can be used to offset the downward gravitation force of the moveable member and effectively make the moveable member weightless.

Figure 12:
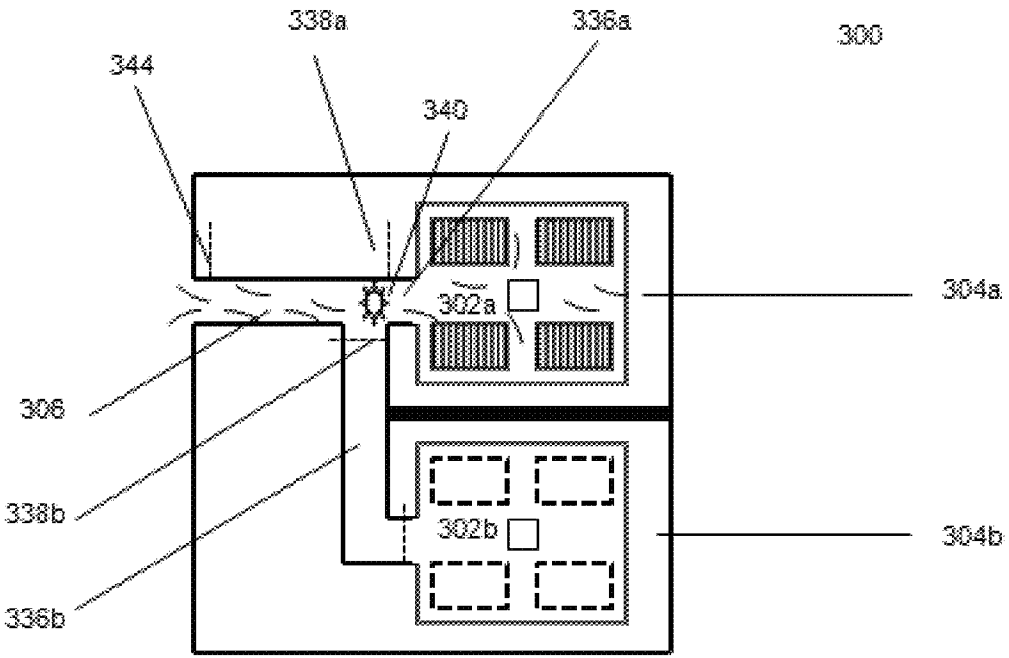
FIG. 12 is a top plan view of an energy producing system, in accordance with the present invention.

An energy producing structure may be provided comprising two or more energy producing units. The energy producing structure permits continuous energy production by staggering energy production cycles of energy producing units to permit an energy extraction device to continuously extract kinetic energy from falling fluid. As illustrated in FIG. 12, a top view of an energy producing structure 300 is shown having two energy producing units 302*a*, 302*b*. The energy producing structure 300 permits continuous energy production by staggering energy production cycles of energy producing units 302*a*, 302*b* to permit an energy extraction device 340 to continuously extract kinetic energy from falling fluid 306. For example, as a first energy producing unit 302*a* rises to a risen position, the other energy producing unit 302*b* sinks to a lowered position. The energy producing structure 300 has two conduits 336*a*, 336*b* in sidewalls of the host structure 304*a*, 304*b*, respectively. Two conduit valves 338*a*, 338*b* control the flow of fluid between energy producing units 302*a*, 302*b*, respectively. To improve control of fluid, a third conduit valve 344 may be positioned at the mouth of the conduit. A second energy extraction device may be provided such that an energy extraction device is positioned in each of the conduits 336*a*, 336*b*.

In another example, as soon as the inlet conduit valve is closed in a first energy producing unit which prevents further fluid from entering the expandable compartment, falling fluid could be diverted to a second energy producing unit to provide continuous extraction of kinetic energy.

The foregoing description illustrates only certain preferred embodiments of the invention. The invention is not limited to the foregoing examples. That is, persons skilled in the art will appreciate and understand that modifications and variations are, or will be, possible to utilize and carry out the teachings of the invention described herein. Accordingly, all suitable modifications, variations and equivalents may be resorted to, and such modifications, variations and equivalents are intended to fall within the scope of the invention as described and within the scope of the claims.

What is claimed is:

1. An energy producing unit comprising:

a host structure immersed in a main body of fluid, the host structure having at least one side wall, and a horizontal wall, the horizontal wall having a horizontal wall valve, the at least one side wall open to the main body of fluid at a lower portion;

a chamber fixed relative to the host structure, the chamber having a bottom wall and at least one side wall;

a moveable member having a first horizontal member disposed within the chamber, a second horizontal member disposed below the horizontal wall in the main body of fluid and at least one support connecting the horizontal members, the support passing through the horizontal wall, the moveable member being independently vertically movable relative to the host structure between a risen position and a lowered position, the moveable member being buoyantly biased to the risen position;

the first horizontal member of the moveable member having a first horizontal member valve, the first horizontal member disposed within the chamber to divide the chamber into an upper reservoir and a lower reservoir, such that when the first horizontal member valve is open, fluid may pass between the upper and lower reservoirs and when closed, prevents fluid communication between such reservoirs;

an expandable compartment formed between the at least one side wall of the host structure, the horizontal wall and the second horizontal member of the moveable member, the horizontal wall disposed at an upper portion of the expandable compartment, the expandable compartment expanding and retracting when the second horizontal member of moveable member is vertically moved between the risen position and the lowered position;

at least one side wall opening disposed on the side wall of the host structure for permitting fluid located in the expandable compartment to flow into the main body of fluid, the side wall opening having a side wall opening valve for controlling the flow of the fluid into the main body of fluid such that when the side wall opening valve is open, fluid may flow from the expandable compartment to the main body of fluid and when closed, the side wall opening valve prevents fluid communication;

an inlet conduit having a lower end and an upper end, the inlet conduit passing through the at least one side wall of the host structure, the inlet conduit open to the expandable compartment at the lower end and open to the exterior of the host structure at the upper end, the inlet conduit permitting fluid located outside the host structure to flow into the expandable compartment, the inlet conduit having at least one inlet conduit valve for controlling the flow of the fluid into the expandable compartment;

an energy extraction device disposed within the inlet conduit to extract kinetic energy as fluid flows through the inlet conduit into the expandable compartment; and an outlet conduit having a lower end and an upper end, the outlet conduit in fluid communication with the lower reservoir at the lower end and in fluid communication to the upper reservoir at the upper end, the outlet conduit permitting fluid located in the lower reservoir to flow into the upper reservoir;

wherein, when the moveable member is in the risen position, the inlet conduit valve opens to fill the expandable compartment with fluid, the moveable member sinks to the lowered position due to increased volume of the fluid in the expandable compartment and by opening the horizontal wall valve, and fluid in the lower reservoir flows into the upper reservoir via the outlet conduit;

and wherein, when the moveable member is in the lowered position, by closing the inlet conduit valve, and horizontal wall valve, fluid flows from the expandable compartment to the main body of fluid by opening the side wall opening valve, and fluid flows from the upper reservoir to the lower reservoir by opening the first horizontal member valve, and the moveable member rises due to buoyant forces to the risen position.

2. The energy producing unit of claim 1, wherein the first horizontal member of the moveable member has a first horizontal member fluid seal disposed between the first horizontal member and the chamber.

3. The energy producing unit of claim 1, wherein the second horizontal member of the moveable member has a second horizontal member fluid seal disposed between the second horizontal member and the at least one side wall of the host structure.

4. The energy producing unit of claim 1, wherein the second horizontal member of the moveable member has a second horizontal member valve for permitting fluid located in the expandable compartment to flow into the main body of fluid, the second horizontal member valve for controlling the flow of the fluid into the main body of fluid such that when second horizontal member valve is open, fluid may flow from the expandable compartment to the main body of fluid and when closed, prevents fluid communication.

5. The energy producing unit of claim 1, further comprising a side conduit positioned in the side wall of the chamber, the side conduit in fluid communication with the lower reservoir at a lower end and in fluid communication to the upper reservoir at an upper end, the side conduit permitting fluid located in the upper reservoir to flow into the lower reservoir, the side conduit having at least one side conduit valve for controlling the flow of the fluid into the lower reservoir such that when the side conduit valve is open, fluid may flow from the upper reservoir to the lower reservoir and when closed, prevents fluid communication.

6. The energy producing unit of claim 1, wherein the moveable member further comprises at least one vertical wall disposed above the first horizontal member.

7. The energy producing unit of claim 1, wherein the outlet conduit further comprises at least one outlet conduit valve for controlling the flow of fluid into the upper reservoir.

8. The energy producing unit of claim 1, further comprising a crane attached to the moveable member for controlling vertical movement of the moveable member in the risen position.

9. The energy producing unit of claim 1, further comprising a latch attached to the host structure for controlling vertical movement of the moveable member in the risen position.

10. The energy producing unit of claim 1, further comprising a counterweight attached to the moveable member to assist movement of the moveable member to the risen position.

11. The energy producing unit of claim 1, further comprising a motorized lift attached to the moveable member for controlling vertical movement of the moveable member.

12. The energy producing unit of claim 1, wherein the energy extraction device is connected to a generator for generating electrical energy.

13. The energy producing unit of claim 1, wherein the side wall of the host structure further comprises at least one chamber wall duct for permitting fluid communication between the chamber and the main body of fluid, the at least one chamber wall duct having a chamber wall duct valve for controlling fluid communication such that the chamber wall duct valve allows fluid communication when open and prevents fluid communication when closed.

14. The energy producing unit of claim 1, wherein the host structure further comprises a bottom horizontal member forming a lower cavity below the moveable member, the bottom horizontal member having a bottom horizontal member valve for controlling the flow of fluid from the lower cavity into the main body of fluid, such that when the bottom horizontal member valve is open, fluid may pass between the lower cavity and the main body of fluid and when closed, prevents fluid communication.

15. The energy producing unit of claim 1, wherein the host structure further comprises a chamber horizontal member above the upper reservoir for permitting fluid located above the chamber horizontal member to flow into the upper reservoir, the chamber horizontal member having a chamber horizontal member valve for releasing fluid into the upper reservoir, such that when the chamber horizontal member valve is open, fluid may drain into the upper reservoir and when closed, the chamber horizontal member valve prevents fluid communication.

16. An energy producing structure comprising at least two energy producing units of claim 1.

17. An energy producing unit comprising:

a host structure immersed in a main body of fluid, the host structure having at least one side wall, a bottom wall and a horizontal wall, the horizontal wall having a horizontal wall valve;

the side wall having openings to permit the main body of fluid to pass through the host structure;

a closed chamber fixed relative to the host structure, the chamber having a top wall, bottom wall and at least one side wall, the chamber disposed within the host structure, the closed chamber containing chamber fluid;

a moveable member having first horizontal member disposed below the horizontal wall, a second horizontal member disposed within the closed chamber and at least one support connecting the members, the support passing through a scaled opening in the top wall of the chamber, the moveable member being independently vertically movable relative to the host structure between a risen position and a lowered position, the moveable member buoyantly biased to the risen position;

the second horizontal member of the moveable member having a second horizontal member valve, the second horizontal member disposed within the closed chamber to divide the closed chamber into an upper reservoir and a lower reservoir, such that when the second horizontal member valve is open, chamber fluid may pass between the lower and upper reservoirs and when closed, prevents fluid communication between such reservoirs;

at least one latch on the side wall of the host structure for holding the moveable member in the risen position;

an expandable compartment formed within the host structure by the at least one side wall of the host structure, the horizontal wall and the first horizontal member of the moveable member, the expandable compartment expanding and retracting when the first horizontal member of moveable member is vertically moved between the risen position and the lowered position;

the first horizontal member of the moveable member having a first horizontal member valve for controlling fluid located in the expandable compartment to flow into the main body of fluid, such that when the first horizontal member valve is open, fluid may flow from the expandable compartment to the main body of fluid and when closed, the first horizontal member valve prevents fluid communication;

an inlet conduit having a lower end and an upper end, the inlet conduit passing through the at least one side wall of the host structure, the inlet conduit open to the upper portion of the expandable compartment at the lower end and open to the exterior of the host structure at the upper end, the inlet conduit permitting fluid located outside the host structure to flow into the expandable compartment, the inlet conduit having at least one inlet conduit valve for controlling the flow of the fluid into the expandable compartment;

an energy extraction device disposed within the inlet conduit to extract kinetic energy as fluid flows through the inlet conduit into the expandable compartment; and an outlet conduit having a lower end and an upper end, the outlet conduit in fluid communication with the lower reservoir at the lower end and in fluid communication to the upper reservoir at the upper end, the outlet conduit permitting fluid located in the lower reservoir to flow into the upper reservoir, the outlet conduit having at least one outlet conduit valve for controlling the flow of the fluid into the upper reservoir;

wherein, when the moveable member is in the risen position, by opening the horizontal wall valve, the outlet conduit valve and the inlet conduit valve, the expandable compartment fills with fluid, the moveable member sinks to the lowered position due to increased weight of the fluid on the first horizontal member of the moveable member, and fluid in the lower reservoir flows into the upper reservoir;

and wherein, when the moveable member is in the lowered position, by closing the inlet conduit valve, horizontal wall valve and outlet conduit valve, and opening the first horizontal member valve and the second horizontal member valve, fluid flows from the expandable compartment to the main body of fluid, fluid flows from the upper reservoir to the lower reservoir, and the moveable member rises due to buoyant forces to the risen position.

18. The energy producing unit of claim 17, wherein the first horizontal member of the moveable member has a first horizontal member fluid seal disposed between the first horizontal member and the at least one side wall of the host structure.

19. The energy producing unit of claim 17, wherein the second horizontal member valve of the moveable member has a second horizontal member fluid seal disposed between the second horizontal member and the side of the chamber.

20. The energy producing unit of claim 17, further comprising a counterweight attached to the moveable member to assist movement of the moveable member to the risen position.

21. An energy producing structure comprising at least two energy producing units of claim 17.

* * * * *